US012012566B2

(12) United States Patent
Cawich et al.

(10) Patent No.: US 12,012,566 B2
(45) Date of Patent: Jun. 18, 2024

(54) LUBRICANT COMPOSITION

(71) Applicant: Idemitsu Kosan Co., Ltd., Tokyo (JP)

(72) Inventors: Pedro Cawich, Wixom, MI (US); Takashi Yanagihara, Chiyoda-Ku (JP)

(73) Assignee: Idemitsu Kosan Co., Ltd. (JP)

( * ) Notice: Subject to any disclaimer, the term of this patent is extended or adjusted under 35 U.S.C. 154(b) by 0 days.

(21) Appl. No.: 17/979,320

(22) Filed: Nov. 2, 2022

(65) Prior Publication Data

US 2024/0141248 A1 May 2, 2024

(51) Int. Cl.

| | |
|---|---|
| ***C10M 105/38*** | (2006.01) |
| ***C10M 107/02*** | (2006.01) |
| ***C10M 107/34*** | (2006.01) |
| ***C10M 111/04*** | (2006.01) |
| ***C10M 159/00*** | (2006.01) |
| ***C10M 169/04*** | (2006.01) |
| *C10N 30/06* | (2006.01) |
| *C10N 40/25* | (2006.01) |

(52) U.S. Cl.

CPC ..... *C10M 111/04* (2013.01); *C10M 105/38* (2013.01); *C10M 107/02* (2013.01); *C10M 107/34* (2013.01); *C10M 159/00* (2013.01); *C10M 169/042* (2013.01); *C10M 2205/0206* (2013.01); *C10M 2207/2835* (2013.01); *C10M 2209/1033* (2013.01); *C10N 2030/06* (2013.01); *C10N 2040/25* (2013.01)

(58) Field of Classification Search

CPC ..... C10M 111/04; C10M 105/38; C10M 107/02; C10M 107/34; C10M 159/00; C10M 169/042; C10M 2205/0206; C10M 2207/2835; C10M 2209/1033; C10N 2030/06; C10N 2040/25

See application file for complete search history.

(56) References Cited

U.S. PATENT DOCUMENTS

| | | | | |
|---|---|---|---|---|
| 2018/0305634 | A1 | 10/2018 | Scholz et al. | |
| 2019/0119597 | A1* | 4/2019 | Sunagawa | C10M 135/20 |
| 2019/0249102 | A1* | 8/2019 | Martin | C10M 107/34 |
| 2019/0367835 | A1* | 12/2019 | Ransom | C10M 133/04 |
| 2021/0139805 | A1* | 5/2021 | Champagne | C10M 105/38 |
| 2021/0292676 | A1* | 9/2021 | Kubo | C10M 135/36 |

FOREIGN PATENT DOCUMENTS

| | | | | |
|---|---|---|---|---|
| WO | WO-2012070007 A1 * | 5/2012 | | C10M 107/24 |

* cited by examiner

*Primary Examiner* — Taiwo Oladapo

(74) *Attorney, Agent, or Firm* — Harness, Dickey & Pierce, P.L.C.

(57) ABSTRACT

A motor configured to power an electric or hybrid vehicle, comprising a lubricant oil composition including a polyalkylene glycol (PAG) base oil, at least one of a poly-alpha-olefin (PAO) and an ester, and an additive package that includes at least a sulfur-based extreme pressure agent.

9 Claims, 1 Drawing Sheet

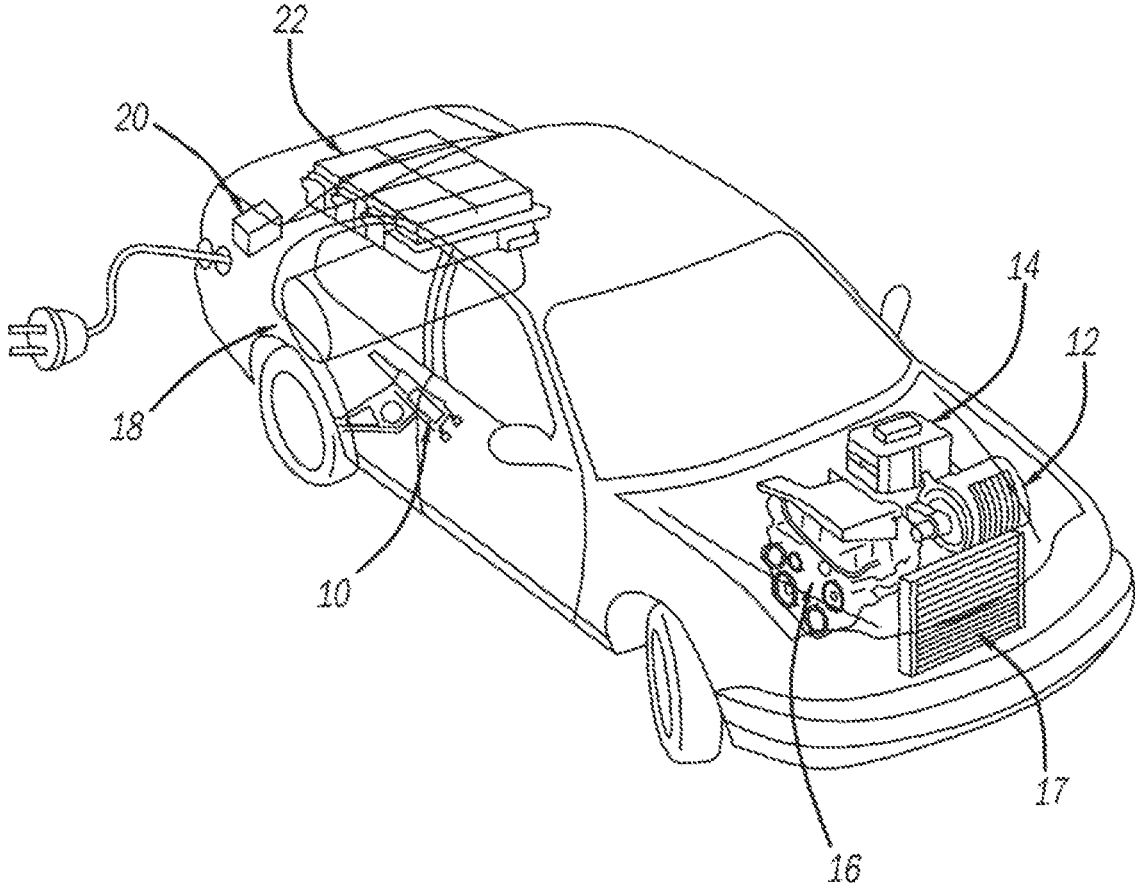
22
20
18
10
14
12
17
16

LUBRICANT COMPOSITION

FIELD

The present disclosure relates to a motor lubricant composition for an electric or hybrid vehicle.

BACKGROUND

This section provides background information related to the present disclosure which is not necessarily prior art.

Electric and hybrid vehicles are becoming more prevalent as societies attempt to combat climate change by reducing the amount of carbon dioxide produced through combustion of fossil fuels that are used to power internal combustion engine vehicles. Electric vehicles and, to a lesser extent, hybrid vehicles each utilize electric motors. These electric motors generate heat during use that needs to be dissipated. One of the ways to dissipate heat generated by the electric motor is to use a cooling lubricant oil composition in the electric motor that includes various additives.

For example, U.S. Patent Application Publication No. 2019/0249102 describes a lubricant composition for cooling and/or lubricating the engine of an electric vehicle that includes at least one polyalkylene glycol. In addition to the at least one polyalkylene glycol, the lubricant composition may include additives such as friction modifiers, detergents, anti-wear additives, extreme-pressure additives, viscosity index improvers, dispersants, antioxidants, pour point improvers, defoaming agents, thickeners, and mixtures thereof. Unfortunately, some additives are not necessarily soluble in polyalkylene glycols, which can undesirably affect performance of the lubricant composition.

SUMMARY

This section provides a general summary of the disclosure and is not a comprehensive disclosure of its full scope or all of its features.

According to a first aspect of the present disclosure, the present disclosure provides a motor configured to power an electric or hybrid vehicle, comprising a lubricant oil composition including a polyalkylene glycol (PAG) base oil, at least one of a poly-alpha-olefin (PAO) and an ester, and an additive package that includes at least a sulfur-based extreme pressure agent.

According to a second aspect, the lubricant oil composition includes the PAO.

According to a third aspect, the lubricant oil composition includes the ester.

According to a fourth aspect, the ester includes at least one of a diester and a polyol ester.

According to the fifth aspect, the lubricant oil composition includes each of the diester and the polyol ester.

According to a sixth aspect, the lubricant oil composition includes each of the PAO and the ester.

According to a seventh aspect, where the composition includes each of the PAO and the ester, the ester includes at least one of a diester and a polyol ester.

According to an eighth aspect, where the composition includes each of the PAO and the ester, the lubricant oil composition includes each of the diester and the polyol ester.

According to a ninth aspect, the lubricant oil composition includes 10% by mass or more of the PAG.

According to a tenth aspect, the lubricant oil composition includes PAO in an amount up to 12.5% by mass.

According to an eleventh aspect, the lubricant oil composition includes the ester in an amount up to 43% by mass.

According to a twelfth aspect, where the lubricant oil composition includes the ester in an amount up to 43% by mass, the ester includes a diester and a polyol ester, an amount of the diester is up to 13% by mass, and an amount of the polyol ester is up to 30% by mass.

According to a thirteenth aspect, the sulfur-based extreme pressure agent is a sulfur aliphatic acid.

According to a fourteenth aspect, the additive package includes at least one of an antioxidant, a phosphorus-based extreme pressure agent, a friction modifier, and a metal deactivator.

According to a fifteenth aspect, the lubricant oil composition includes up to 3% by mass of the additive package.

According to a sixteenth aspect, wherein the lubricant oil composition includes up to 3% by mass of the additive package, the additive package includes an amount of the sulfur-based extreme pressure agent that is greater than 0% by mass and less than or equal to 0.2% by mass.

According to a seventeenth aspect, a density of the lubricant oil composition is in the range of 0.98 $g/cm^3$ to 1.10 $g/cm^3$ According to an eighteenth aspect, the lubricant oil composition includes 50% by mass or more of the PAG.

According to a nineteenth aspect, the lubricant oil composition does not include PAO and includes 50% by mass or more of the PAG.

According to a twentieth aspect, the lubricant oil composition includes each of the ester and the PAO, and an amount of the PAG is 50% by mass or more.

According to a twenty-first aspect, there is provided a lubricant oil composition that may include a polyalkylene glycol (PAG) base oil, at least one of a poly-alpha-olefin (PAO) and an ester for a motor configured to power an electric or hybrid vehicle.

According to a twenty-second aspect, there is provided a lubricant oil composition that may include a polyalkylene glycol (PAG) base oil, at least one of a poly-alpha-olefin (PAO) and an ester, and an additive package that includes at least a sulfur-based extreme pressure agent for a motor configured to power an electric or hybrid vehicle.

According to a twenty-third aspect, there is provided a lubricant oil composition that may include a polyalkylene glycol (PAG) base oil, at least one of a poly-alpha-olefin (PAO) and an ester for a motor configured to power an electric or hybrid vehicle, and the lubricant oil composition includes 10% by mass or more of the PAG.

According to a twenty-fourth aspect, there is provided a lubricant oil composition that may include a polyalkylene glycol (PAG) base oil, at least one of a poly-alpha-olefin (PAO) and an ester, and an additive package that includes at least a sulfur-based extreme pressure agent for a motor configured to power an electric or hybrid vehicle, and the lubricant oil composition includes 10% by mass or more of the PAG.

Further areas of applicability will become apparent from the description provided herein. The description and specific examples in this summary are intended for purposes of illustration only and are not intended to limit the scope of the present disclosure.

DRAWINGS

The drawing described herein is for illustrative purposes only of selected embodiments and not all possible implementations, and is not intended to limit the scope of the present disclosure.

The FIGURE illustrates a vehicle having an electric or hybrid motor including a lubricant oil composition according to a principle of the present disclosure.

DETAILED DESCRIPTION

Example embodiments will now be described more fully with reference to the accompanying drawing.

The FIGURE illustrates a vehicle 10 according to a principle of the present disclosure. The vehicle 10 in the illustrated embodiment is a hybrid vehicle including an electric motor 12 and associated power electronics 14, an internal combustion engine 16, a radiator 17 for cooling the engine 16, a fuel source 18, a charger 20, and a battery 22. If vehicle 10 is an electric vehicle, engine 16 and fuel source 18 may be omitted.

The present disclosure is directed to a lubricant composition for an electric motor of an electric or hybrid vehicle. The lubricant composition includes (A) a base oil that includes at least a polyalkylene glycol (PAG). The lubricant composition may also include an additive package that includes at least an extreme pressure agent. Extreme pressure agents, however, are not necessarily soluble in PAG. Thus, according to the present disclosure, the lubricant composition further includes at least one (B) an ester and (C) a poly-alpha-olefin. Extreme pressure agents have a greater solubility in these materials. It should be understood that the additive package may include various additives in addition to the extreme pressure agent including, for example, antioxidants, metal deactivators, and the like. It should also be understood that the additional additives are also not necessarily soluble, or less soluble, in PAG. The additional additives of the lubricant composition also have a greater solubility in esters and poly-alpha-olefins.

According to the present disclosure, the lubricant composition for an electric motor or motor 12 of a hybrid vehicle includes a base oil, which includes at least one PAG. It should be understood, however, that the lubricant composition can include a blend of two or more PAGs. Examples of PAGs include polymers obtained by polymerization or copolymerization of alkylene oxide.

Regardless of the number of PAGs used in the base oil (A), a number average molecular weight (Mn) of the PAGs used therein may be in the range of 300 to 10,000; more preferably 400 to 5,000; still more preferably 500 to 3,000; and even still more preferably 600 to 1,500 from the viewpoint of improving the viscosity index of the lubricating oil composition. The number average molecular weight (Mn) is a value as expressed in terms of standard polystyrene, measured by gel permeation chromatography (GPC), and measurement conditions include conditions described in Examples.

The PAG may have the below general formula (1), and may have at least one end sealed with a substituent, which may assist suppressing sludge precipitation during use of the lubricating composition. Examples of the substituent capable of sealing the end of the PAG include a monovalent hydrocarbon group having 1 to 10 carbon atoms, an acyl group having 2 to 10 carbon atoms, or a heterocyclic group having 3 to 10 ring atoms. Preferably, the substituent is a monovalent hydrocarbon group having 1 to 10 carbon atoms. Examples of specific groups regarding the monovalent hydrocarbon group, acyl group, and heterocyclic group that can be selected as the substituent, and the range of the preferable number of the carbon atoms or ring atoms is the same as defined in $R^{A1}$ and $R^{A3}$ in the following general formula (1).

$$R_{A1}—[(OR^{A2})_a—OR^{A3}]_b \quad (1)$$

In the general formula (1), $R^{A1}$ may be a hydrogen atom, a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms; $R^{A2}$ may be an alkylene group having 2 to 4 carbon atoms; $R^{A3}$ may be a hydrogen atom, a monovalent hydrocarbon group having 1 to 10 carbon atoms, an acyl group having 2 to 10 carbon atoms, or a heterocyclic group having 3 to 10 ring atoms; "a" may be a number of 1 or more, and is a value appropriately determined according to the value of the number average molecular weight of the compound represented by the general formula (1); and "b" may be an integer of 1 to 6, preferably an integer of 1 to 4, more preferably 1 to 3, and still more preferably 1.

When two or more different kinds of the compound represented by general formula (1) are used, "a" may be an average value (a weighted average value), and the average value may be 1 or more.

Further, "b" may be determined according to the number of the binding site with $R^{A1}$ in the general formula (1). For example, when $R^{A1}$ is a monovalent hydrocarbon group such as an alkyl group or a cycloalkyl group, or an acyl group, "b" is 1. In other words, when $R^{A1}$ is a hydrocarbon group or a heterocyclic group, and the valence of the group is 1, 2, 3, 4, 5, and 6, "b" is 1, 2, 3, 4, 5 and 6, respectively.

When there are a plurality of $R^{A2}$ and $R^{A3}$, $R^{A2}$ and $R^{A3}$ may be the same as or different from each other.

In one embodiment, at least one of $R^{A1}$ and $R^{A3}$ in the general formula (1) is preferably a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms, and more preferably a monovalent hydrocarbon group having 1 to 10 carbon atoms.

Examples of the monovalent hydrocarbon group having 1 to 10 carbon atoms which can be selected as $R^{A1}$ and $R^{A3}$ include alkyl groups such as a methyl group, an ethyl group, a propyl group (a n-propyl group, an isopropyl group), a butyl group (a n-butyl group, an isobutyl group, an s-butyl group, a t-butyl group), a pentyl group, a hexyl group, a heptyl group, an octyl group, a nonyl group, and a decyl group; cycloalkyl groups such as a cyclopentyl group, a cyclohexyl group, a methylcyclohexyl group, an ethylcyclohexyl group, a propylcyclohexyl group, and a dimethyl cyclohexyl group; aryl groups such as a phenyl group, a methylphenyl group, an ethylphenyl group, a dimethyl phenyl group, a propyl phenyl group, a trimethylphenyl group, a butylphenyl group, and a naphthyl group; arylalkyl groups such as a benzyl group, a phenylethyl, a methylbenzyl group, a phenylpropyl group, and a phenylbutyl group.

Further, the alkyl group may be either linear or branched.

As noted above, the number of carbon atoms of the monovalent hydrocarbon group may be 1 to 10. More preferably, the number of carbon atoms is 1 to 6, and still more preferably the number of carbon atoms is 1 to 4.

The hydrocarbon group moiety in the acyl group having 2 to 10 carbon atoms which can be selected as $R^{A1}$ and $R^{A3}$ may be linear, branched, or cyclic. The hydrocarbon group moiety includes those having 1 to 9 carbon atoms among the monovalent hydrocarbon groups which can be selected as $R^{A1}$ and $R^{A3}$.

Further, the number of carbon atoms of the acyl group is preferably 2 to 10, and more preferably 2 to 6.

The divalent to hexavalent hydrocarbon group which can be selected as $R^{A1}$ includes residues obtained by removing 1 to 5 hydrogen atoms from the monovalent hydrocarbon group which can be selected as $R^{A1}$ and residues obtained by removing a hydroxy group from polyhydric alcohols, such as trimethylolpropane, glycerin, pentaerythritol, sorbitol, 1,2,3-trihydroxycyclohexane, and 1,3,5-trihydroxycyclohexane.

Further, the number of carbon atoms of the divalent to hexavalent hydrocarbon group is preferably 1 to 10, more preferably 1 to 6, and still more preferably 1 to 4.

The heterocyclic group having 3 to 10 ring atoms which can be selected as $R^{A1}$ and $R^{A3}$ is preferably an oxygen atom-containing heterocyclic group or a sulfur atom-containing heterocyclic group. Further, the heterocyclic group may be a saturated ring or an unsaturated ring.

Examples of the oxygen atom-containing heterocyclic group include residues obtained by removing 1 to 6 hydrogen atoms from an oxygen atom-containing saturated heterocyclic ring, such as 1,3-propylene oxide, tetrahydrofuran, tetrahydropyran, and hexamethylene oxide, and an oxygen atom-containing unsaturated heterocyclic ring, such as acetylene oxide, furan, pyran, oxycycloheptatriene, isobenzofuran, and isochromene.

Examples of the sulfur atom-containing heterocyclic group include residues obtained by removing 1 to 6 hydrogen atoms from a sulfur atom-containing saturated heterocyclic ring, such as ethylene sulfide, trimethylene sulfide, tetrahydrothiophene, tetrahydrothiopyran, and hexamethylene sulfide, and a sulfur atom-containing unsaturated heterocyclic ring, such as acetylene sulfide, thiophene, thiapyran, and thioterpyridine.

The number of ring atoms of the heterocyclic group is preferably 3 to 10, more preferably 3 to 6, and still more preferably 5 or 6.

Examples of the alkylene group having 2 to 4 carbon atoms that can be selected as $R^{A2}$ include an alkylene group having 2 carbon atoms, such as an ethylene group (—$CH_2CH_2$—) and an ethylidene group (—$CH(CH_3)$—); an alkylene group having 3 carbon atoms, such as a trimethylene group (— $CH_2CH_2CH_2$—), a propylene group (—$CH(CH_3)CH_2$—), a propylidene group (—$CHCH_2CH_3$—), and an isopropylidene group (—$C(CH_3)_2$—); and an alkylene group having 4 carbon atoms, such as a tetramethylene group (—$CH_2CH_2CH_2CH_2$—), a 1-methyltrimethylene group (—$CH(CH_3)CH_2CH_2$—), a 2-methyltrimethylene group (—$CH_2CH(CH_3)CH_2$—), and a butylene group (—$C(CH_3)_2CH_2$—).

Further, when there are a plurality of $R^{A2}$ s, the $R^{A2}$ s may be the same as each other or may be a combination of two or more kinds of alkylene groups. Among these, $R^{A2}$ is preferably a propylene group (—$CH(CH_3CH_2$—).

In the compound represented by the general formula (1), the content of the oxypropylene unit (—$OCH(CH_3)CH_2$—) is preferably 50% by mol to 100% by mol, more preferably 65% by mol to 100% by mol, and still more preferably 80% by mol to 100% by mol, based on the total amount (100% by mol) of the oxyalkylene unit ($OR^{A2}$) in the structure of the compound.

The kinematic viscosity at 40° C. of the polyalkylene glycol (A1) used in one embodiment of the present invention is preferably 8 $mm^2/s$ to 350 $mm^2/s$, more preferably 10 $mm^2/s$ to 150 $mm^2/s$, still more preferably 12 $mm^2/s$ to 100 $mm^2/s$, and even still more preferably 15 $mm^2/s$ to 68 $mm^2/s$.

The kinematic viscosity at 100° C. of the polyalkylene glycol (A1) is preferably 12 $mm^2/s$ or less; more preferably 10 $mm^2/s$ or less; even more preferably 5 $mm^2/s$ or less; still more preferably 1 $mm^2/s$ or more and less than 5 $mm^2/s$, and most preferably 3 $mm^2/s$ or more but less than 5 $mm^2/s$.

Further, the viscosity index of the polyalkylene glycol (A1) used in one embodiment of the present invention is preferably 90 or more, more preferably 100 or more, still more preferably 110 or more, and even still more preferably 120 or more.

The content of the PAG in the lubricant oil composition may be 10% by mass or more, preferably 25% by mass or more, more preferably 40% by mass or more, still more preferably 50% by mass or more, based on the total amount (100% by mass) of the lubricant oil composition. This content may be selected from the viewpoint of providing a lubricant oil composition that is improved in the effect of suppressing sludge precipitation and the effect of suppressing deterioration of demulsibility due to blending of additives. The upper limit of the content of PAG in the lubricant oil composition is preferably 95% by mass or less, more preferably 90% by mass or less, and still more preferably 80% by mass or less.

The lubricant oil composition for a motor of an electric or hybrid vehicle according to the present disclosure may include at least one ester. The ester in the composition may be a diester that includes two ester groups or a polyol ester that includes three or more ester groups. The lubricant oil composition may include a single diester, a single polyol ester, two or more diesters, two or more polyol esters, or at least one diester and at least one polyol ester. Similar to the use of PAO described below, the use of an ester in the lubricant oil composition assists in increasing the solubility of additives used in the lubricant oil composition. Preferably, the lubricant oil composition includes at least one polyol ester and at least one diester. A total amount of ester in the lubricant oil composition may be in the range of 5-50% by mass, preferably in the range of 10-48% by mass, and more preferably in the range of 20-48% by mass. A content of the at least one polyol ester may be up to 30% by mass, and a content of the at least one diester may be up to 13.0% by mass.

Examples of the polyol ester include esters that are obtained through reaction between a polyol and a carboxylic acid compound. It should be understood, however, that the polyol ester may be either a fully esterified compound or a partial ester. The polyol that constitutes the polyol ester may preferably be an aliphatic polyol having 2 to 15 carbon atoms, and more preferably an aliphatic polyol having 2 to 8 carbon atoms.

Specific examples of the polyol include ethylene glycol, propylene glycol, butylene glycol, neopentyl glycol, trimethylolethane, ditrimethylolethane, trimethylolpropane, ditrimethylolpropane, glycerin, pentaerythritol, dipentaerythritol, tripentaerythritol, sorbitol, and the like. Among these, trivalent or multivalent aliphatic polyols are preferable.

As the carboxylic acid compound that constitutes the polyol ester, it is preferred to use a fatty acid having 12 to 24 carbon atoms. The fatty acid may be either linear or branched, and saturated and unsaturated alkyl groups may be included. In addition, the carboxylic acid compound may be a monovalent carboxylic acid, such as stearic acid, oleic acid, and the like. Further, the carboxylic acid compound may be a polyvalent carboxylic acid such as succinic acid, adipic acid, pimelic acid, azelaic acid, sebacic acid, phthalic acid, isophthalic acid, and the like. Among these carboxylic acid compounds, stearic acid and oleic acid are preferable.

The lubricant composition of the present disclosure may include at least one poly-alpha-olefin (PAO). Example PAOs include materials such as polybutene, polyisobutylene, a 1-octene oligomer, a 1-decene oligomer, an ethylene-propylene copolymer, and a hydrogenated product of a PAO. The selected PAO should have low volatility, good oxidation stability, and a low viscosity. Preferably, the viscosity of the PAO should be in the range of 2.0 to 5.0 $mm^2/s$. PAO, in general, is a non-polar substance. This is significant because various additives that will be described below also tend to be non-polar substances, and the non-polar additives do not dissolve as well in polar substances such as PAG described above. Thus, the use of PAO is effective in increasing the solubility of the selected additives in the lubricant oil composition in comparison to, for example, a mineral oil that is not necessarily compatible with a base oil such as PAG.

In addition, the use of PAO is effective at balancing the kinematic viscosity of the lubricant oil composition at 100 degrees C. In particular, when the lubricant oil composition includes PAO, the kinematic viscosity at 100 degrees C. may be in the range of 4.0 to 4.5 $mm^2/s$. It should be understood, however, that this range may be variable. That is, it is contemplated that the kinematic viscosity at 100 degrees C. may be less than 4.0 $mm^2/s$ or greater than 4.5 $mm^2/s$ depending on the type of electric or hybrid motor. That is, the kinematic viscosity can be adjusted based on the load carrying capability of the motor, the desired thickness of the lubricant film during use of the motor, and suitability at various operating temperatures of the motor.

The alpha-olefin serving as a raw material of the PAO may be either linear or branched. The alpha-olefin serving as a raw material of the PAO may have 8 to 20 carbon atoms, and more preferably 8 to 12 carbon atoms. Among those, 1-decene having 10 carbon atoms is preferred.

The amount of the at least one PAO may be 0 to 12.5% by mass, more preferably 1.5 to 12.5% by mass, and still more preferably 5.0 to 12.5% by mass on the basis of the total amount of the lubricant oil composition. When the blending amount of the component is 1.5% by mass or more, the cooling properties of the electric or hybrid motor can be made excellent. At amounts greater than 12.5% by mass, solubility of the additives contained in the lubricant oil composition may be lessened.

In addition to the PAG and at least one of an ester and PAO, the lubricant oil composition according to the present disclosure may contain an additive package that includes at least a sulfur-based extreme pressure agent. Other additives that the additive package may include are antioxidants, other extreme pressure agents, friction modifiers, metal deactivators, and combinations thereof.

Preferably, the lubricant oil composition includes a sulfur-based extreme pressure agent in an amount up to 0.5% by mass, and preferably up to 0.2% by mass. An example sulfur-based extreme pressure agent is a sulfur aliphatic acid. If other additives are included such as antioxidants, friction modifiers, metal deactivators, and other extreme pressure agents such as a phosphorus-based extreme pressure agent, the total amount of these additives is preferably up to about 3% by mass, and preferably up to about 2.15% by mass.

Various additives that are preferably not included in the lubricant oil composition include additives such as viscosity index improvers, dispersants, pour point depressants, and antifoaming agents. These additives are preferably not used because these additives are typically used in lubricants for, for example, a shock absorber or a vehicle transmission. In this regard, while the properties and characteristics of the lubricants used in a shock absorber or vehicle transmission may be compatible with electric motor applications, the inventors have determined that the additives used in these types of lubricants are not optimized for use in an electric motor application, not needed in an electric motor application, and may even degrade performance of the lubricant composition in an electric motor application.

The below Table 1 lists various example lubricant oil compositions according to the present disclosure (i.e., Examples 1 to 3) and a Comparative Example.

TABLE 1

| | Ex. 1 | Ex. 2 | Ex. 3 | Com. Ex. |
|---|---|---|---|---|
| PAO, Kinematic viscosity at 100° C. = 3.4 mm2/s | 12.5 | — | — | — |
| PAG, Kinematic viscosity at 100° C. = 4.6 mm2/s | 55.95 | 55.95 | 55.95 | 97.65 |
| Ester-based oil, Kinematic viscosity at 100° C. = 2.0 mm2/s | — | 12.5 | — | — |
| Ester-based oil, Kinematic viscosity at 100° C. = 3.2 mm2/s | — | — | 12.5 | — |
| Ester-based oil, Kin. Viscosity at 100° C. = 4.4 mm2/s | 29.2 | 29.2 | 29.2 | — |
| S-based EP agent | 0.2 | 0.2 | 0.2 | 0.2 |
| Additives | 2.15 | 2.15 | 2.15 | 2.15 |
| Total | 100 | 100 | 100 | 100 |

As can be seen in Table 1, each example composition includes PAG and at least one of a PAO and an ester. The comparative example, in contrast, does not include a PAO or an ester. The S-based extreme pressure agent in each composition was a sulfur aliphatic acid, and the additives in each composition included a blend of an antioxidant, friction modifier, metal deactivator, and a P-based extreme pressure agent.

Within a few days of forming each composition, the solubility of the additives in each composition was observed at room temperature. In example 1, the additives were soluble, but the composition separated into two layers. The additives were soluble in examples 2, 3, and the comparative example. After exposing the compositions to low temperature testing (i.e., −5 degrees C. for 5 days), the additives in examples 1-3 were soluble (i.e., the solutions were clear), but the additives in the comparative example were not soluble (i.e., the solution was no longer clear, but rather cloudy due to the additives precipitating out of the solution). Thus, the examples provide evidence that use of at least one of PAO and an ester are effective at increasing the solubility of the additives in the lubricant oil composition in comparison to compositions that only include PAG.

It is desirable that the lubricant oil composition for an electric or hybrid motor have various properties. For example, a density of the lubricant oil composition at 20 degrees C. may be in the range of 0.98 g/cm$^3$ to 1.10 g/cm$^3$, Preferably, the density is in the range of 0.98 g/cm$^3$ to 1.02 g/cm$^3$.

Another property that can be adjusted as desired is the Brookfield viscosity at −40 degrees C. Preferably, the Brookfield viscosity at −40 degrees C. may be in the range of 4000 cP to 7000 cP. Similar to the kinematic viscosity of the composition described above, however, the Brookfield viscosity may be less than or greater than this range based on the type of electric or hybrid motor and its desired operating conditions. Indeed, the Brookfield viscosity at −40 degrees C. can be as high as 10000 cP, if desired.

Another property that is important is the load carrying capacity of the lubricant oil composition. The load carrying capacity of the lubricant oil composition can be tested by subjecting the lubricant oil composition to a four ball extreme pressure test, which tests extreme pressure performance of the lubricant oil composition. Extreme pressure performance is critical for motor oils. The four ball extreme pressure test can be used to determine the last non-seizure load (LNSL) measured in kg, which is the point at which minor periodic breakdown of the lubrication film begins to occur; to measure the weld point at which the four balls weld together (a higher weld point indicates a more effective extreme pressure lubricant) measured in kg; and measure the load wear index (LWI) measured in kg of the lubricant composition. The amount of wear on the four balls used in the pressure test can also be measured in mm, which is indicative of the lubricating performance of the lubricant oil composition. The LNSL of the lubricant oil composition is at least 100 kg; the weld point is at least 160 kg and up to 200 kg; the LWI is at least 40.18 kg; and the amount of wear of the four balls is in the range of 0.418 to 0.423 mm.

The below Table 2 summarizes various properties of the example compositions relative to the comparative example.

TABLE 2

| | | Ex. 1 | Ex. 2 | Ex. 3 | Comp. Ex. |
|---|---|---|---|---|---|
| | KV @ 100° C. | 4.242 | 4.286 | 4.287 | 4.887 |
| | KV @ 40° C. | 18.11 | 17.73 | 17.73 | 20.81 |
| | Brookfield Vis. @−40° C./1$^{st}$ Exp. | Split | clear | slightly cloudy | Cloudy |
| | Brookfield Vis. @−40° C./2$^{nd}$ Exp. | split | clear | cloudy | cloudy |
| Observation at Room Temperature | | split | clear | clear | clear |
| Observation at −5 degrees C. for five days | | split | clear | clear | cloudy |
| | Vis. Index | 145 | 156 | 156 | 169 |
| | Density @ 20° C. | | 0.98 | 0.98 | 1.02 |
| Element | P content | 720 | 748 | 728 | 754 |
| Content | S content | 1004 | 980 | 951 | 971 |
| 4 Ball | LNSL (kg) | 100 | 100 | 100 | 63 |
| EP | Weld Pt (kg) | 200 | 160 | 160 | 160 |
| | LWI (kg) | 41.59 | 40.24 | 40.18 | 38.58 |
| | 4 Ball Wear (mm) | 0.423 | 0.422 | 0.418 | 0.433 |
| Thermal | 20 | 0.150 | 0.150 | 0.149 | 0.157 |
| Conductivity | 40 | 0.148 | 0.148 | 0.147 | 0.155 |
| | 60 | 0.145 | 0.146 | 0.145 | 0.151 |
| | 80 | 0.142 | 0.144 | 0.143 | 0.151 |
| | 100 | 0.140 | 0.141 | 0.141 | 0.148 |

In Table 2, when a sample is identified as "clear," it means that all the additives contained in the lubricant oil composition were completely soluble. If a sample is identified as "split," it means that some of the additives dissolved in only part of the lubricant oil composition. If a sample is identified as "cloudy," it means that at least some the additives did not dissolve in the lubricant oil composition. Lastly, if a sample is identified as "slightly cloudy," it means that at least some of the additives did not dissolve in the lubricant oil composition, but to a lesser extent in comparison to a "cloudy" composition. Thus, the order of preference for solubility of the additives in the lubricant oil composition is (1) clear; (2) split; and (3) slightly cloudy. A cloudy lubricant oil composition is not preferred because the additives did not dissolve in the lubricant oil composition.

As can be seen in Table 2, the example compositions exhibited superior wear resistance in comparison to the comparative example.

Yet another property for the lubricant oil composition is the thermal conductivity thereof. It is desirable to have the highest possible thermal conductivity to provide advantageous thermal management during use in an electric or hybrid motor. At temperatures of 80 degrees C., the lubricant oil compositions of the present disclosure exhibit a thermal conductivity in excess of 0.33 W/mk. At temperatures of 100 degrees C., the lubricant oil compositions exhibit a thermal conductivity in excess of 0.31 W/mk.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A motor configured to power an electric or hybrid vehicle, comprising a lubricant oil composition, the lubricant oil composition including:

a polyalkylene glycol (PAG) base oil;

at least one diester and at least one polyol ester that includes three or more ester groups;

an additive package that includes at least a sulfur-based extreme pressure agent; and optionally a poly-alpha-olefin (PAO), wherein a total amount of the at least one diester and the at least one polyol ester in the lubricant oll composition is in the range of 20 to 43% by mass;

an amount of the at least one diester being up to 13% by mass, and an amount of the at least one polyol ester being at least 7% by mass and up to 30% by mass;

the sulfur-based extreme pressure agent includes a sulfur aliphatic acid;

the lubricant oil composition includes 50% by mass or more of the PAG; and the PAG has an average molecular weight (Mn) in the range of 500 to 3000.

2. The motor according to claim 1, wherein the lubricant oil composition includes the PAO.

3. The motor according to claim 1, wherein the lubricant oil composition includes PAO in an amount up to 12.5% by mass.

4. The motor according to claim 1, wherein the additive package includes at least one of an antioxidant, a phosphorus-based extreme pressure agent, a friction modifier, and a metal deactivator.

5. The motor according to claim 1, wherein the lubricant oil composition includes up to 3% by mass of the additive package.

6. The motor according to claim 5, wherein the additive package includes an amount of the sulfur-based extreme pressure agent that is greater than 0% by mass and less than or equal to 0.2% by mass.

7. The motor according to claim 1, wherein a density of the lubricant oil composition is in the range of 0.98 $g/cm^3$ to 1.10 $g/cm^3$.

8. The motor according to claim 1, wherein the lubricant oil composition does not include PAO.

9. The motor according to claim 1, wherein the lubricant oil composition includes PAO in an amount that ranges between 1.5 to 12.5% by mass.

* * * * *